US007019763B2

(12) United States Patent
Kimura

(10) Patent No.: US 7,019,763 B2
(45) Date of Patent: Mar. 28, 2006

(54) DISPLAY DEVICE, DRIVING METHOD THEREFOR, ELECTRO-OPTICAL DEVICE, DRIVING METHOD THEREFOR, AND ELECTRONIC APPARATUS

(75) Inventor: Mutsumi Kimura, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 281 days.

(21) Appl. No.: 10/036,396

(22) Filed: Jan. 7, 2002

(65) Prior Publication Data

US 2002/0118153 A1 Aug. 29, 2002

(30) Foreign Application Priority Data

Jan. 9, 2001 (JP) ..... 2001-001853

(51) Int. Cl.
*G09G 5/02* (2006.01)

(52) U.S. Cl. ..... 345/694; 345/695; 345/613

(58) Field of Classification Search ..... 345/613, 345/694–696, 87, 89, 690, 77; 341/144
See application file for complete search history.

(56) References Cited

U.S. PATENT DOCUMENTS 5,357,583 A * 10/1994 Sato et al. ..... 382/269
5,438,442 A * 8/1995 Katakura ..... 349/144
5,469,281 A * 11/1995 Katakura et al. ..... 345/89
5,471,225 A * 11/1995 Parks ..... 345/98
5,539,546 A 7/1996 Koden et al.
5,712,652 A * 1/1998 Sato et al. ..... 345/90
5,798,746 A * 8/1998 Koyama ..... 345/98
5,808,594 A * 9/1998 Tsuboyama et al. ..... 345/89
5,905,482 A * 5/1999 Hughes et al. ..... 345/89
6,057,897 A 5/2000 Ichikawa et al.
6,239,777 B1 * 5/2001 Sugahara et al. ..... 345/85
6,271,820 B1 * 8/2001 Bock et al. ..... 345/97
6,339,417 B1 * 1/2002 Quanrud ..... 345/98
6,396,505 B1 * 5/2002 Lui et al. ..... 345/613
6,417,868 B1 * 7/2002 Bock et al. ..... 345/698
6,697,037 B1 * 2/2004 Alt et al. ..... 345/93
6,765,549 B1 * 7/2004 Yamazaki et al. ..... 345/80
2002/0101396 A1 * 8/2002 Huston ..... 345/87

FOREIGN PATENT DOCUMENTS

CN 1182887 5/1998
JP 410104580 A * 4/1998
WO WO 00/77565 A1 12/2000

OTHER PUBLICATIONS

SID, "Toshiba Integrates SRAM into Low-temperature Polysilicon AMLCDs", Industry News, Aug. 2, 2000.*

(Continued)

*Primary Examiner*—Ricardo Osorio
(74) *Attorney, Agent, or Firm*—Oliff & Berridge, PLC

(57) ABSTRACT

The invention provides an electro-optical device including pixels disposed in a matrix at intersections of a plurality of signal lines and a plurality of scanning lines. Each of said pixels includes sub-pixels that are each provided with a static random access memory and an electro-optical element.

22 Claims, 7 Drawing Sheets

OTHER PUBLICATIONS

Shimoda, T. et al., "Multicolor Pixel Patterning of Light-Emitting Polymers by Ink-Jet Printing", *SID 99 DIGEST*, pp. 376-379.

Kanbe, Sadao et al., "Patterning of High Performance Poly (dialkylfluorene) derivatives for Light-Emitting Full Color Display by Ink-jet Printing", *Proc. Euro Display '99 Late-News Papers* (1999), pp. 85-88.

Shimoda, Tatsuya et al., "High Resolution Light Emitting Polymer Display Driven by Low Temperature Polysilicon Thin Film Transistor with Integrated Driver", *Asia Display 98*, pp. 217-220.

* cited by examiner (a)

(b)

DISPLAY DEVICE, DRIVING METHOD THEREFOR, ELECTRO-OPTICAL DEVICE, DRIVING METHOD THEREFOR, AND ELECTRONIC APPARATUS

BACKGROUND OF THE INVENTION

1. Field of Invention

The present invention particularly relates to a display device suitable for reducing power consumption, a driving method therefor, an electro-optical device, a driving method therefor, and an electronic apparatus.

2. Description of Related Art

An important function required for display devices is a grayscale display function. Several grayscale systems are employed to provide this function. Related art grayscale display methods include: (i) a method for performing control of an analog current or an analog voltage applied to pixels; (ii) an area-ratio grayscale method for performing control of the display states of sub-pixels forming the pixels to either the ON state or the OFF state and by changing the ratio of the number of sub-pixels in the ON state to the number of sub-pixels in the OFF state; and (iii) a time-ratio grayscale method for performing control of the period during which pixels are in the ON state and the period during which pixels are in the OFF state.

SUMMARY OF THE INVENTION

Recently developed portable apparatuses, such as cellular telephones, have display devices, such as liquid crystal display devices and organic electro-luminescence display devices, therein. Accordingly, there are increasing demands not only for providing a grayscale display function, but also for reducing the power consumption and increasing the life of display devices.

Accordingly, it is one object of the present inventions to provide a display device that can realize lower power consumption and a longer life, and also to provide a driving method suitable for reducing power consumption and prolonging a life of display device.

A display device of the present invention includes pixels disposed in a matrix. Each of the pixels include a plurality of sub-pixels. The sub-pixels each include a static random access memory. Since each pixel of the display device includes a plurality of sub-pixels, grayscale display can be performed by controlling the display state of each sub-pixel. Also in this display device, since each sub-pixel includes a static random access memory, it is not necessary to supply a scanning signal to the sub-pixel except when display data is rewritten, thereby making it possible to decrease the scanning frequency or reduce the scanning operations. Accordingly, this configuration is effective for lower power consumption and prolonging a device life. Not only regular static random access memories, but also pseudo-static random access memories or synchronous static random access memories, may be used as the static random access memories for the display device.

In the above-described display device, the sub-pixels may be set in either an ON state or an OFF state. With this arrangement, it is possible to easily control the display state by electrical signals. If the sub-pixels are controlled by thin-film transistors (hereinafter referred to as "TFTs"), it is possible to minimize the influence of variations in the characteristics on the display state.

In the above-described display device, a grayscale level may be set by a function of the ratio of the maximum luminance level of each of the pixels to the sum of luminance levels of the sub-pixels in the ON state in each of the pixels. Each sub-pixel exhibiting a predetermined luminance level when it is in the ON state is controlled to be either in the ON state or the OFF state, and the sum of the luminance levels of the sub-pixels which are in the ON state is changed according to the image signal, thereby performing grayscale display. Accordingly, even if there is a variation in the photoelectric characteristics in the individual sub-pixels, grayscale display can be performed. The maximum grayscale level is the sum of the luminance levels when all of the sub-pixels contained in each pixel are in the ON state.

In the above-described display device, a grayscale level may be set by a function of the ratio of the area occupied by each of the pixels to a total area occupied by the sub-pixels in the ON state included in the each of the pixels. In such a display device, even if there is a variation in the photoelectric characteristics in the individual sub-pixels, grayscale display can be performed.

In the above-described display device, the sub-pixels may each include a liquid crystal display element. In this case, since a liquid crystal display element is used as the display element, it is possible to achieve thinner and lighter display devices.

Either a transmission type or a reflection type can be used as the liquid crystal display element. The reflection type is suitable for ensuring the aperture ratio since active elements, such as transistors, and wiring patterns can be integrated and disposed in a space under the reflection-type liquid crystal display element opposite to the light emitting side.

In the above-described display device, the sub-pixels may each include an organic electro-luminescence display element. In this case, since an organic electro-luminescence display element is used as the display element, it is possible to achieve thinner and lighter display devices, and a wide viewing angle can also be obtained.

A first driving method in accordance with the invention drives a display device that includes pixels disposed in a matrix, each of the pixels including a plurality of sub-pixels provided with a static random access memory. The sub-pixels are controlled to be either in an ON state or an OFF state, and a grayscale is obtained by using the ratio of the area occupied by each of the pixels to a total area occupied by the sub-pixels in the ON state included in each of the pixels.

A second driving method in accordance with the invention drives a display device that includes pixels disposed in a matrix, each of the pixels including a plurality of sub-pixels provided with a static random access memory. The sub-pixels are controlled to be either in an ON state or an OFF state, and a grayscale is obtained by using the ratio of the maximum luminance level of each of the pixels to the sum of luminance levels of the sub-pixels which in the ON state in the each of the pixels.

In the above-described driving methods for display devices, even when halftone grayscale levels are displayed, only the ON state or the OFF state of the sub-pixels are used. Accordingly, even if there is a variation in the photoelectric characteristics in the individual sub-pixels, grayscale display can be performed.

A first electro-optical device of the present invention includes pixels disposed in a matrix at intersections of a plurality of signal lines and a plurality of scanning lines. Each of the pixels includes sub-pixels each provided with a static random access memory and an electro-optical element.

In the above-described electro-optical device, the luminance of each of the electro-optical elements has two values including a lower luminance level and a higher luminance level. The two values indicate, for example, a luminance level of zero and the maximum luminance level, respectively. With this arrangement, the data signal supplied to the pixel via the signal line can be simplified. Accordingly, the circuit configuration of the signal-line drive circuit can also be simplified, and the area occupied by the signal-line drive circuit can also be reduced.

In the above-described electro-optical device, a grayscale level may be set as a function of the sum of luminance levels of the electro-optical elements contained in the pixel.

In the above-described electro-optical device, a grayscale level may be set as a function of the ratio of a total area occupied by all the electro-optical elements contained in one of the pixels to a total area occupied by the electro-optical elements that are set at the higher luminance level.

In the above-described electro-optical device, the electro-optical elements may be liquid crystal elements. Either a transmission type or a reflection type can be used as the liquid crystal display elements. In order to reduce power consumption, a reflection type, which does not require a light source, is preferably used. The reflection type is also suitable for ensuring the aperture ratio since active elements, such as transistors, and wiring patterns can be integrated and disposed in a space under the reflection-type liquid crystal element opposite to the light emitting side.

In the above-described electro-optical device, the electro-optical elements may be organic electro-luminescence elements.

A driving method in accordance with the invention drives an electro-optical device that includes pixels disposed in a matrix at intersections of a plurality of signal lines and a plurality of scanning lines, each of the pixels including sub-pixels each provided with an electro-optical element being disposed within the pixel. The driving method includes: a step of supplying a data signal to control a luminance level of the electro-optical elements to either a higher luminance level or a lower luminance level via the plurality of signal lines; and a step of retaining the data signal in a static random access memory disposed within each of the sub-pixels.

In the above-described driving method for an electro-optical device, the lower luminance level and the higher luminance level of the electro-optical elements may be set to a luminance level of zero and the maximum luminance level, respectively.

An electronic apparatus of the present invention is provided with the above-described display device or the electro-optical device.

DETAILED DESCRIPTION OF PREFERRED EMBODIMENTS

Typical embodiments of the present invention are described below.

(First Embodiment)

Figure 1:
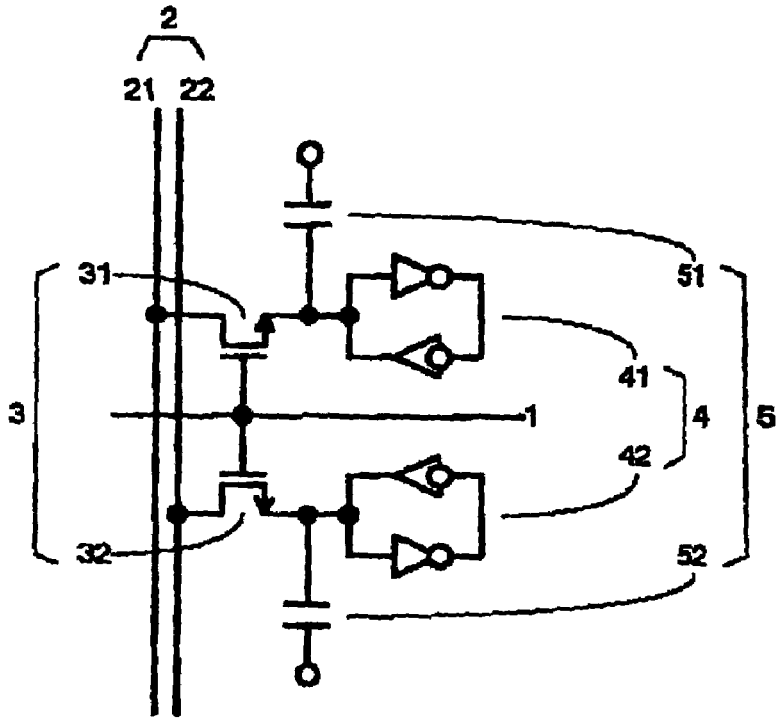
FIG. 1 is a pixel equivalent circuit diagram of a first embodiment according to the present invention.

As an embodiment of the present invention, a display device is described below in which a plurality of sub-pixels, each being provided with a liquid crystal element and a static random access memory, are disposed as electro-optical elements within one pixel. FIG. 1 is an equivalent circuit diagram of a pixel of the display device. Although only one pixel is shown in FIG. 1, in practice, a plurality of pixels are disposed in a matrix at the intersections of scanning lines to send scanning signals to pixels and signal lines to send data signals to the pixels. Within one pixel, transistors 3, static random access memories 4, and liquid crystal elements 5 are formed. Thin-film transistors (TFTs), silicon-based transistors, or so-called organic transistors using an aromatic or conjugated organic semiconductor material as a semiconductor layer can be employed as the transistors 3. Thin-film transistors include, for example, amorphous silicon thin-film transistors, polycrystalline thin-film transistors, and monocrystalline transistors. If the silicon-based transistors are utilized, it is preferable that transistors formed on a silicon substrate be divided into chips including a single transistor or a plurality of transistors, and the divided chips are then re-disposed at predetermined positions of an insulating substrate, such as glass. The silicon-based transistors produced as described above are then used as the thin-film transistors.

CMOS-inverter-type static random access memories, depletion-load-type memories or high-resistance polycrystalline silicon load-type memories can be used as the static random access memories 4. A transistor type similar to the transistors 3 can be used as the transistors forming the static random access memories 4. However, in order to exhibit the functions as the static random access memories 4, polycrystalline silicon thin-film transistors, a monocrystalline silicon transistors, or silicon-based transistors are preferably used. Either transmission-type liquid crystal elements or reflection-type liquid crystal elements can be used as the liquid crystal elements 5. However, if it is necessary to reduce the power consumption, reflection-type liquid crystal devices which do not need a light source, such as backlight, are preferable.

It is preferable that signal lines be provided according to the number of bits of the data signal. For example, if a two-bit data signal is supplied, a lower-bit signal line 21 and a higher-bit signal line 22 are provided as signal lines 2, as indicated by the equivalent circuit diagram shown in FIG. 1.

In accordance with these signal lines, a lower-bit transistor 31 and a higher-bit transistor 32 are disposed as the transistors 3. Similarly, as the static random access memories 4, a lower-bit static random access memory 41 and a higher-bit random access memory 42 are disposed as the static random access memory 4. A lower-bit liquid crystal element 51 and a higher-bit liquid crystal element 52 are disposed as the liquid crystal elements 5.

The static random access memories 41 and 42 can be directly connected to the word line (or scanning line) and the data line. Alternatively, as shown in FIG. 1, the static random access memories 41 and 42 may be disposed such that they are connected to the signal lines 2 via the transistors 3 whose gates are connected to a scanning line 1. With this arrangement, it is not necessary to provide scanning lines (word lines) according to the number of sub-pixels. Accordingly, an undesirable wiring capacitance generated between wiring patterns can be reduced, thereby reducing or preventing a delay caused when data is rewritten.

According to the data signals supplied from the signal lines 21 and 22, the luminance levels of each of the liquid crystal elements 51 and 52 are preferably set to two values, i.e., a high level and a low level (for example, a luminance of 0 and the maximum luminance), respectively. For example, the lower luminance levels of the liquid crystal elements 51 and 52 are set to be the same (for example, a luminance of 0), while the higher luminance levels thereof are set at a ratio of 1:2. As a result, four grayscale levels can be obtained with a two-bit data signal. If the average luminance (luminance per unit area) of the lower luminance level and the higher luminance level of the liquid crystal element 51 is substantially the same as that of the liquid crystal element 52, the area of the liquid crystal element 51 is differentiated from that of the liquid crystal element 52, thereby obtaining the maximum number of grayscale levels in response to a supplied data signal. For example, by setting the ratio of the area of the liquid crystal element 52 to that of the liquid crystal element 51 to 2:1, four grayscale levels can be obtained with a two-bit data signal.

If a static random access memory is not used, a selection pulse must be supplied to the pixel circuit via a scanning line at regular intervals. In this embodiment, however, by using the static random access memories 4 as storage elements, a selection pulse is only supplied to the pixel circuit when data is subsequently rewritten. That is, while a selection pulse is applied to the scanning line 1, a data signal is applied to the signal lines 2 and is then supplied to the static random access memories 4 via the transistors 3. The supplied data signal is retained in the static random access memories 4 until data is subsequently rewritten. Light reflection or light transmission of the liquid crystal elements 5 is controlled based on the data retained in the static random access memories 4.

As the liquid crystal elements 5, reflection-type liquid crystal elements which do not need a light source, such as backlight, are suitable to reduce power consumption. Although in the equivalent circuit shown in FIG. 1 a 2-bit data signal is supplied, a data signal having 3 or more bits may be supplied. In this case, the concept of the present invention can be maintained.

(Second Embodiment)

Figure 3:
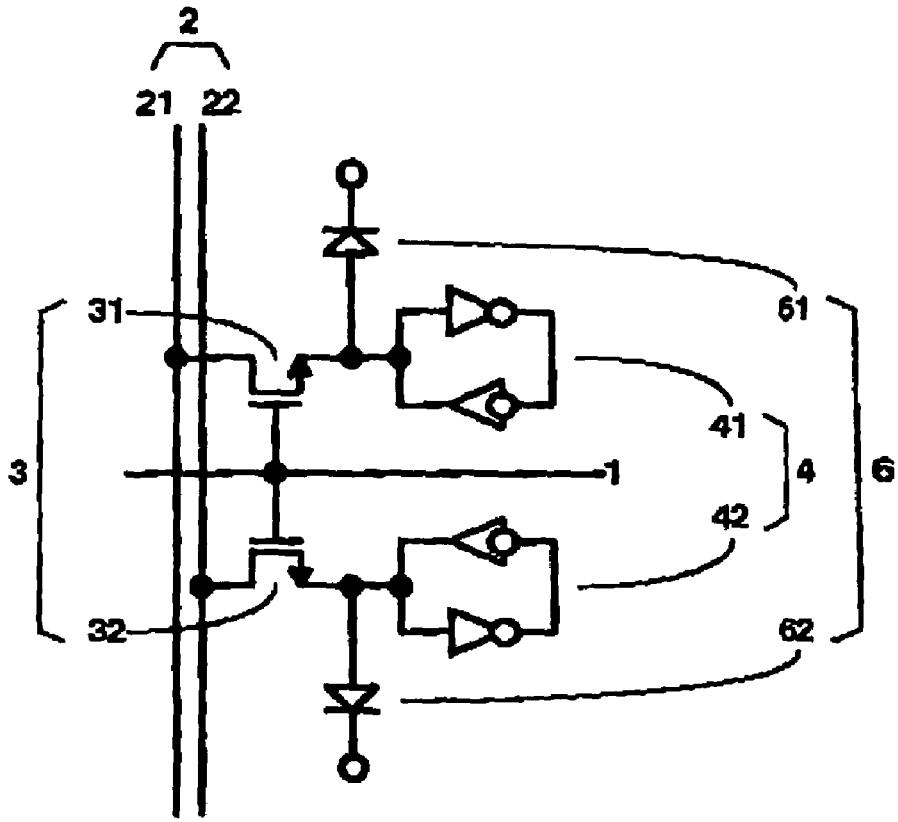
FIG. 3 is a pixel equivalent circuit diagram of a second embodiment according to the present invention.

As an embodiment of the present invention, a display device is described below in which a plurality of sub-pixels, provided with organic electro-luminescence elements 6 and static random access memories 4, are disposed as electro-optical elements within one pixel. FIG. 3 is an equivalent circuit diagram of a pixel of the display device. Although only one pixel is shown in FIG. 3, in practice, a plurality of pixels are disposed in a matrix at the intersections of scanning lines to send scanning signals to the pixels and signal lines to send data signals to the pixels. Transistors 3, the static random access memories 4, and the organic electro-luminescence elements are formed in one pixel. Thin-film transistors (TFTs), silicon-based transistors, or so-called organic transistors using an aromatic or conjugated organic semiconductor material as a semiconductor layer can be used as the transistors 3. Thin-film transistors include, for example, amorphous silicon thin-film transistors, polycrystalline thin-film transistors, and monocrystalline transistors. If silicon-based transistors are utilized, it is preferable that transistors formed on a silicon substrate be divided into chips including a single transistor or a plurality of transistors, and the divided chips are then re-disposed at predetermined positions of an insulating substrate, such as glass. The silicon-based transistors produced as described above are then used as the thin-film transistors.

CMOS-inverter-type static random access memories, depletion-load-type memories, high-resistance polycrystalline silicon load-type memories can be used as the static random access memories 4. A transistor type similar to the transistors 3 can be used as the transistors forming the static random access memories 4. However, in order to exhibit the functions as the static random access memories 4, polycrystalline silicon thin-film transistors, monocrystalline silicon transistors, or silicon-based transistors are preferably used.

Polymer materials, such as polyphenylenes and polyphenylene vinylenes, or low-molecular-weight materials, such as coumarine and rhodamine, can be used as the luminance material for the organic electro-luminescence elements 6.

It is preferable that signal lines be provided according to the number of bits of the data signal. For example, if a two-bit data signal is supplied, a lower-bit signal line 21 and a higher-bit signal line 22 are provided as signal lines 2, as indicated by the equivalent circuit diagram shown in FIG. 3.

In accordance with these signal lines, a lower-bit transistor 31 and a higher-bit transistor 32 are disposed as the transistors 3. Similarly, as the static random access memories 4, a lower-bit static random access memory 41 and a higher-bit static random access memory 42 are disposed. As the organic electro-luminescence elements 6, a lower-bit organic electro-luminescence element 61 and a higher-bit electro-luminescence element 62 are disposed.

The static random access memories 41 and 42 can be directly connected to the word line (or scanning line) and the data line. Alternatively, as shown in FIG. 3, the static random access memories 41 and 42 may be disposed such that they are connected to the signal line 2 via the transistors 3 whose gates are connected to the scanning line 1. With this arrangement, it is not necessary to provide scanning lines (word lines) according to the number of sub-pixels. Accordingly, an undesirable wiring capacitance generated between wiring patterns can be reduced, thereby preventing a delay caused when data is rewritten. Additionally, in particular, in a so-called back-emission-type display device that allows light to be emitted from the circuit substrate on which transistors and wiring patterns are disposed, the light emission efficiency is enhanced with a smaller number of transistors and wiring patterns.

According to the data signals supplied from the signal lines 21 and 22, the luminance levels of each of the organic electro-luminescence elements 61 and 62 are preferably set to two values, i.e., a high level and a low level (for example, a luminance of 0 and the maximum luminance), respectively. For example, the lower luminance levels of the organic electro-luminescence elements 61 and 62 are set to be the same (for example, a luminance of 0), while the higher luminance levels thereof are set at a ratio of 1:2. As a result, four grayscale levels can be obtained with a two-bit data signal. If the average luminance (luminance per unit area) of the lower luminance level and the higher luminance level of the organic electro-luminescence element 61 is substantially the same as that of the organic electro-luminescence element 62, the area of the organic electro-luminescence element 61 is differentiated from that of the organic electro-luminescence element 62, thereby obtaining the maximum number of grayscale levels in response to a supplied data signal. For example, by setting the ratio of the area of the organic electro-luminescence element 62 to that of the organic electro-luminescence element 61 to 2:1, four grayscale levels can be obtained with a two-bit data signal.

If static random access memories are not used, a selection pulse must be supplied to the pixel circuit via the scanning line at regular intervals. In this embodiment, however, by using the static random access memories 4 as storage elements, a selection pulse can only be supplied to the pixel circuit when data is rewritten. That is, while a selection pulse is applied to the scanning line 1, a data signal is applied to the signal lines 2 and is then supplied to the static random access memories 4 via the transistors 3. The supplied data signal is retained in the static random access memories 4 until data is subsequently rewritten. The luminance intensity of the organic electro-luminescence elements 6 is controlled based on the data retained in the static random access memories 4.

Generally, organic electro-luminescence elements using polymer materials are driven at a lower voltage than those using low-molecular-weight materials. Therefore, the amount of current supplied to the organic electro-luminescence elements using polymer materials can be reduced. On the other hand, in order to obtain many grayscale levels, it is necessary to precisely control the amount of current supplied to the organic electro-luminescence elements. As in this embodiment, if the luminance of the organic electro-luminescence element is set to two values, many grayscale levels can be obtained without the need to precisely control the amount of current.

Although in the equivalent circuit shown in FIG. 3 a 2-bit data signal is supplied, a data signal having 3 or more bits may be supplied. In this case, the concept of the present invention can be maintained.

Figure 2:
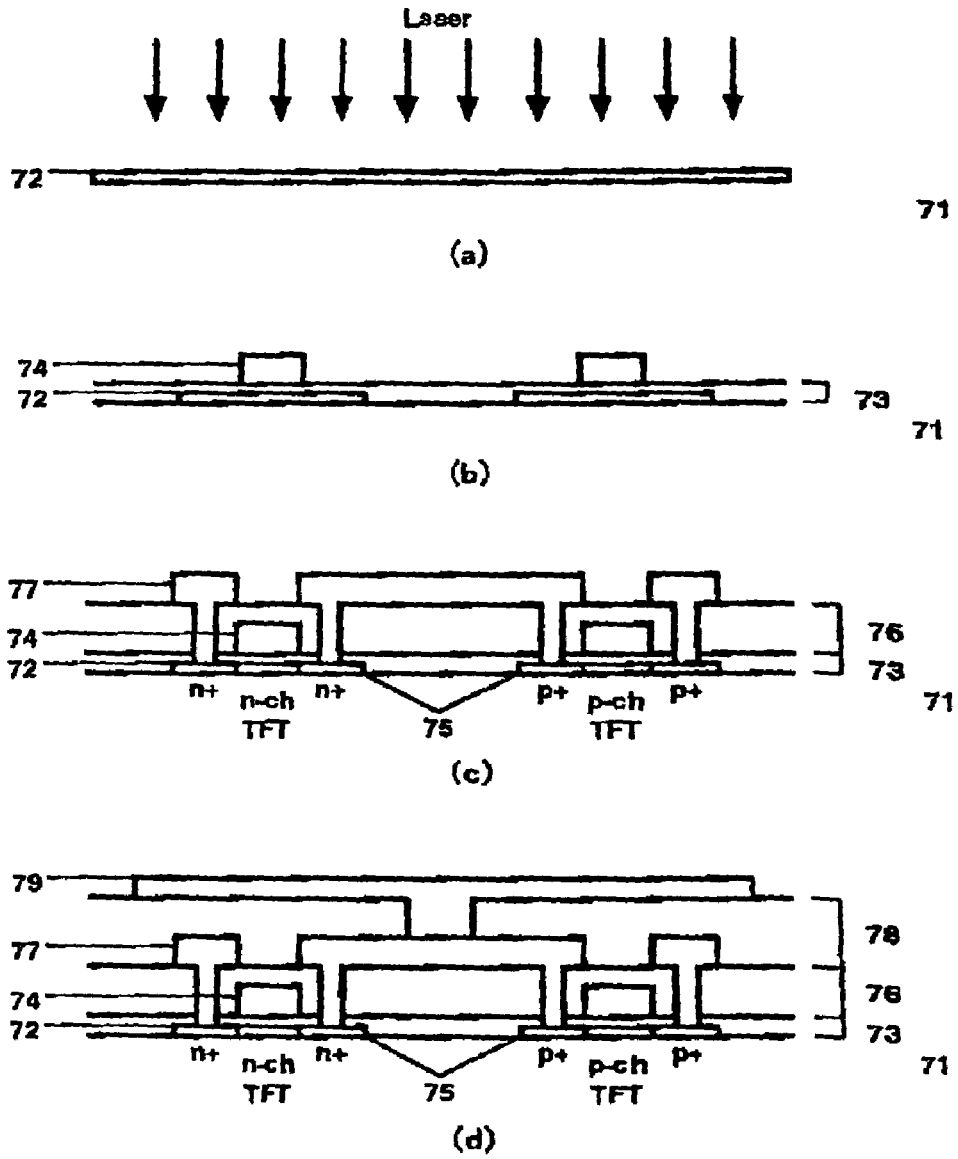
FIGS. 2(*a*)–2(*d*) are schematics that illustrate a manufacturing process for a tin-film transistor of the first embodiment according to the present invention.

A typical manufacturing process for an electro-optical device according to the present invention is described below with reference to FIGS. 2(*a*)–2(*d*).

Amorphous silicon is first formed on a glass substrate 71 according to PECVD using $SiH_4$ or LPCVD using $Si_2H_6$. The amorphous silicon is re-crystalized by applying laser light, such as an excimer laser, or by solid-phase growth so as to form polycrystalline silicon 72 (FIG. 2(*a*)). After the polycrystalline silicon 72 is patterned, a gate insulating film 73 is formed, and then a gate electrode 74 is formed and patterned (FIG. 2(*b*)). An impurity, such as phosphorus or boron, is implanted into the polycrystalline silicon 72 using the gate electrode 74 according to a self-alignment process so as to activate the polycrystalline silicon 72, thereby forming CMOS-structured source and drain regions 75. A first interlayer insulating film 76 is formed, and contact holes are formed in which source and drain electrodes 77 are formed and patterned (FIG. 2(*c*)). Then, a second interlayer insulating film 78 is formed, and contact holes are formed in which a pixel electrode 79 is formed and patterned (FIG. 2(*d*)). The thin-film transistors are disposed behind the pixel electrode 79. Thereafter, a reflection-type liquid crystal display element is formed according to a standard process.

According to the configuration of this embodiment, in contrast to display devices using the area-ratio grayscale method, scanning is only performed when images change, thereby realizing even lower power consumption and a longer life of a drive circuit. Additionally, according to the configuration of this embodiment, static random access memories can be disposed behind the reflection-type liquid crystal display element, thereby reducing or eliminating problems, such as a reduction in the aperture ratio.

Figure 4:
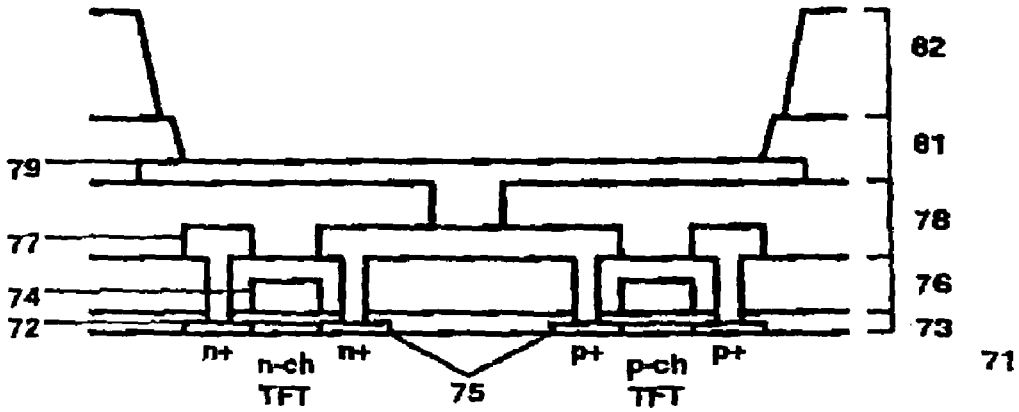
FIGS. 4(*a*) and 4(*b*) are schematics that illustrate a manufacturing processing for an organic electro-luminescence display element of a second embodiment according to the present invention.
Figure 4:
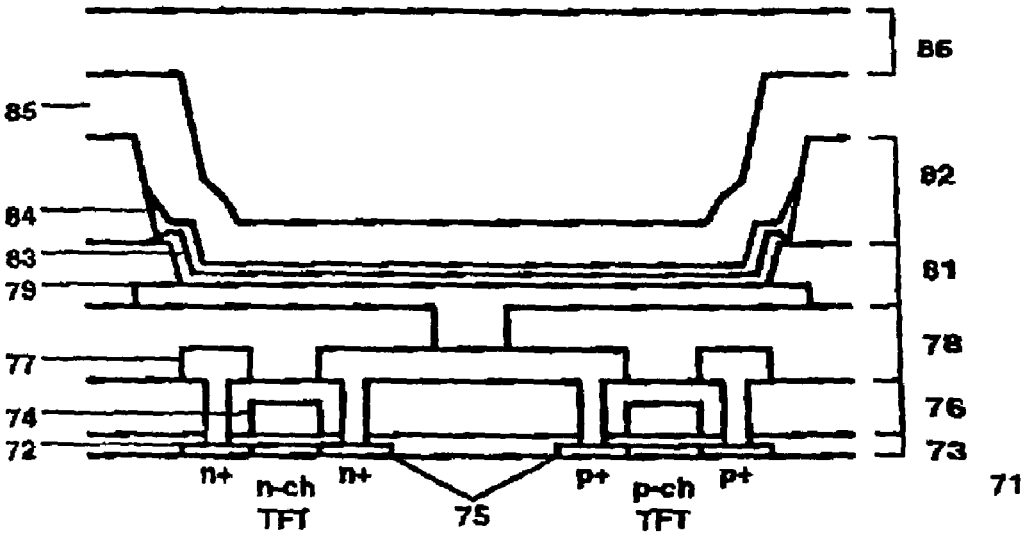

FIGS. 4(*a*) and 4(*b*) illustrate a manufacturing process of an organic electro-luminescence element of the second embodiment. The manufacturing process of the thin-film transistor is similar to that of the first embodiment, as shown in FIG. 2. An adhesion layer 81 is first formed, and an opening is formed therein in which a luminescence region is formed (FIG. 4(*a*)). Then, the wettability of the substrate surface is controlled by plasma processing using, for example, oxygen plasma or $CF_4$ plasma. Thereafter, an electron-hole implantation layer 83 and a luminance layer 84 are formed according to a liquid-phase process, such as a spin-coating, squeezing, or ink-jet process (as disclosed in T. Shimoda, S. Seki, et al., Dig. SID '99 (1999), 376, and S. Kanbe, et al., Proc. Euro Display '99 Late-News Papers (1999), 85), or a vacuum process, such as a sputtering or deposition process. In order to decrease the work function, a cathode 85 containing an alkali metal is formed and is sealed by a sealing agent 86. Then, the organic electro-luminescence element is completed (FIG. 4(*b*)). The role of the adhesion layer 81 is to enhance the adhesion between the substrate and an interlayer 82 and to obtain an accurate luminance area. The role of the interlayer 82 is to separate the cathode 85 from the gate electrode 74, the source and drain electrodes 77 so as to reduce the parasitic capacitance, and to control the wettability of the surface when forming the electron-hole implantation layer 83 and the luminance layer 84 according to a liquid-phase process so as to realize accurate patterning (as disclosed in T. Shimoda, M. Kimura, et al., Proc. Asia Display '98, 217 (1998)).

According to the configuration of this embodiment, in contrast to display devices using the area-ratio grayscale method, scanning is only performed when images change, thereby realizing even lower power consumption and a longer life of the drive circuit. Additionally, static random access memories can be disposed behind the organic electro-luminescence element display device, thereby reducing or eliminating problems, such as a reduction in the aperture ratio.

Figure 5:
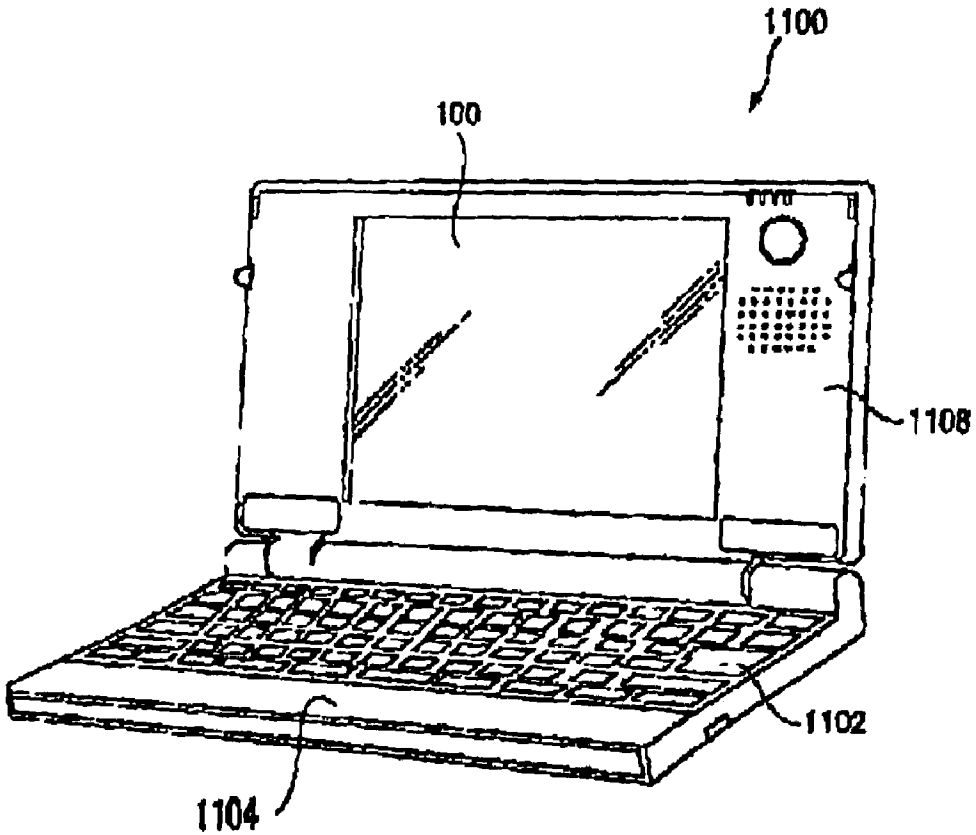
FIG. 5 is a perspective view that illustrates an example of a mobile personal computer to which an electro-optical device according to the present invention is applied.

Some examples of an electronic apparatus to which the above-described electro-optical device is applied are described below. FIG. 5 is a perspective view illustrating the configuration of a mobile personal computer to which the above-described electro-optical device is applied. In FIG. 5, a personal computer 1100 is formed of a main unit 1104 provided with a keyboard 1102 and a display unit 1106. The display unit 1106 is provided with an electro-optical device 100.

Figure 6:
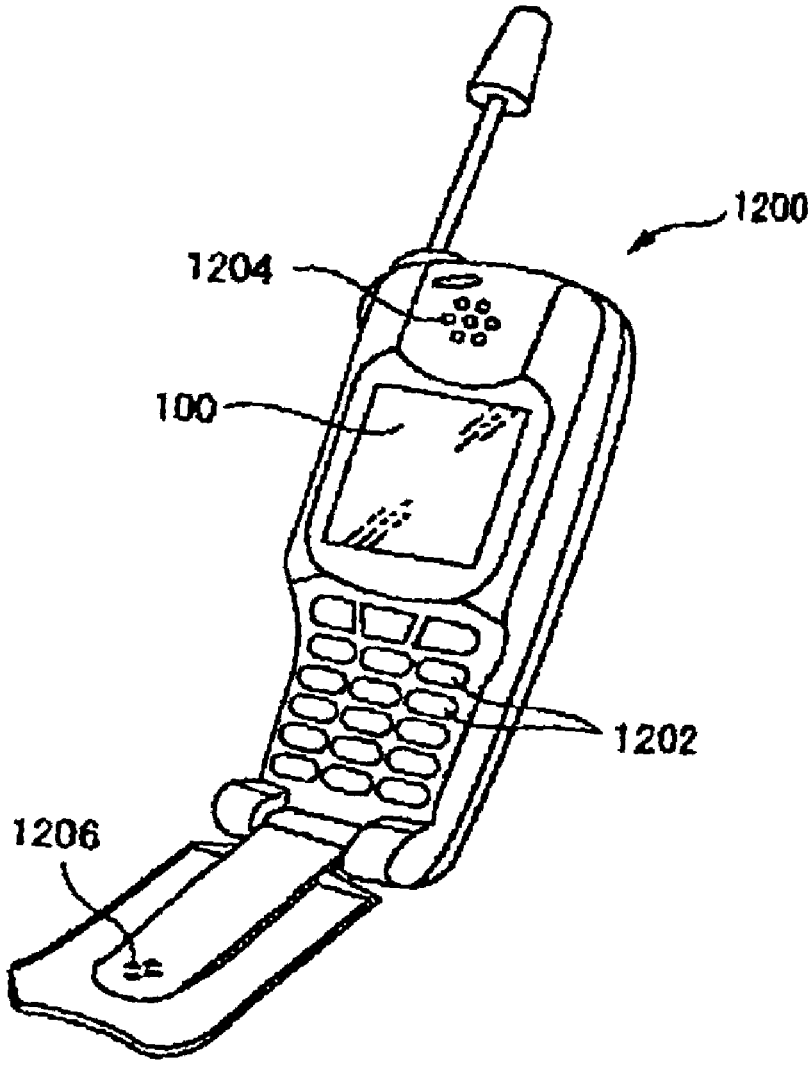
FIG. 6 is a perspective view that illustrates an example of a cellular telephone to which an electro-optical device according to the present invention is applied.

FIG. 6 is a perspective view illustrating the configuration of a cellular telephone having a display portion to which the above-described electro-optical device 100 is applied. In FIG. 6, a cellular telephone 1200 includes not only a plurality of operation buttons 1202, but also an earpiece 1204, a mouthpiece 1206, and the above-described electro-optical device 100.

Figure 7:
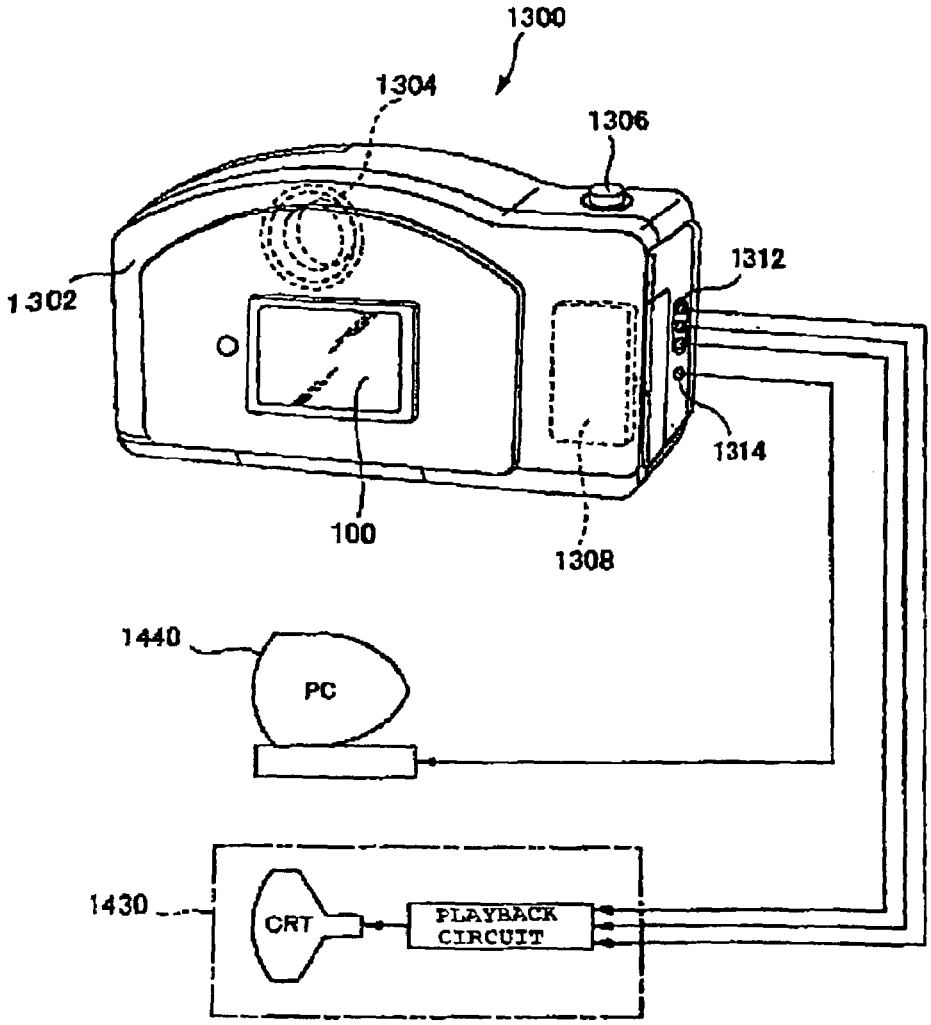
FIG. 7 is a perspective view that illustrates an example of a digital still camera having a finder to which an electro-optical device according to the present invention is applied.

FIG. 7 is a perspective view illustrating the configuration of a digital still camera having a finder to which the above-described electro-optical device 100 is applied. FIG. 7 also schematically illustrates the connection of the digital still camera with external devices. In a regular (non-digital) camera, film is exposed to light by an optical image of a subject. In a digital still camera 1300, however, an optical image of a subject is photoelectrically converted by an image pickup device, such as a CCD (Charge Coupled Device), so as to generate an imaging signal. On the rear surface of a casing 1302 of the digital still camera 1300, the aforementioned electro-optical device 100 is provided to display the subject based on the imaging signal obtained by the CCD. That is, the electro-optical device 100 serves as a finder to display the subject. On the observation side (on the reverse surface in FIG. 7) of the casing 1302, a photodetector unit 1304, including an optical lens and a CCD, is disposed.

A photographer checks the subject displayed on the electro-optical device 100 and presses a shutter button 1306. Then, the imaging signal obtained by the CCD is transferred to and stored in a memory of a circuit board 1308. In this digital still camera 1300, a video signal output terminal 1312 and a data communication input/output terminal 1314 are provided on the side surface of the casing 1302. Then, as shown in FIG. 7, a television monitor 1430 and a personal computer 1440 can be connected to the video signal output terminal 1312 and the data communication input/output terminal 1314, respectively, as required. The imaging signal stored in the memory of the circuit board 1308 can be output to the television monitor 1430 or the personal computer 1440 by a predetermined operation.

Electronic apparatuses to which the electro-optical device 100 of the present invention is applicable include not only the personal computer shown in FIG. 5, the cellular telephone shown in FIG. 6, and the digital still camera shown in FIG. 7, but also a television, a viewfinder-type or direct-view-type video cassette recorder, a car navigation system, a pager, an electronic diary, a calculator, a word processor, a workstation, a videophone, a POS terminal, a device provided with a touch panel, etc., for example. The above-described electro-optical device 100 is applicable to the display units of the above-mentioned electronic apparatuses.

What is claimed is:

1. A display device, comprising:

a plurality of pixels disposed in a matrix, each of said pixels including a plurality of sub-pixels, each of said sub-pixels including a static random access memory and a switching transistor, a size of each of at least two of said sub-pixels being differentiated from each other, a data signal being supplied to the static random access memory through the switching transistor, each of the pixels being disposed at separate intersections of scanning lines and signal lines, each of the pixels including at least two of the sub-pixels, and the static random access memory of the at least two sub-pixels being connected to the same scanning line.

2. The display device according to claim 1, said sub-pixels being set in one of an ON state and an OFF state.

3. The display device according to claim 2, a grayscale level being set by a function of a ratio of a maximum luminance level of each of said pixels to a sum of luminance levels of all of said sub-pixels included in the each of said pixels.

4. The display device according to claim 2, a grayscale level being set by a function of a ratio of an area occupied by each of said pixels to a total area occupied by the sub-pixels in the ON state included in the each of said pixels.

5. The display device according to claim 1, said sub-pixels each including a liquid crystal display element.

6. The display device according to claim 5, said liquid crystal display element being a reflection-type liquid crystal display element.

7. The display device according to claim 1, said sub-pixels each including an organic electro-luminescence display element.

8. An electronic apparatus comprising the display device set forth in claim 1.

9. The display device according to claim 1, the switching transistor including a gate connected to at least one scanning line.

10. The display device according to claim 1, each of said sub-pixels further comprising an electro-optical element disposed between the switching transistor and the static random access memory.

11. A driving method for a display device that includes pixels disposed in a matrix, each of said pixels including a plurality of sub-pixels provided with a static random access memory and a switching transistor, a size of each of at least two of said sub-pixels being differentiated from each other, the driving method comprising:

controlling said sub-pixels to be in one of an ON state and an OFF state;

obtaining a grayscale by using a ratio of an area occupied by each of said pixels to a total area occupied by the sub-pixels in the ON state included in the each of said pixels;

supplying a data signal to the static random access memory through the switching transistor;

disposing each of the pixels at separate intersections of scanning lines and signal lines, each of the pixels including at least two of the sub-pixels; and connecting the static random access memory of the at least two sub-pixels of each of the pixels to the same scanning line.

12. A driving method for a display device that includes pixels disposed in a matrix, each of said pixels including a plurality of sub-pixels provided with a static random access memory and a switching transistor, a size of each of at least two of said sub-pixels being differentiated from each other, the driving method comprising:

controlling said sub-pixels to be in one of an ON state and an OFF state;

obtaining a grayscale by using a ratio of a maximum luminance level of each of said pixels to a sum of luminance levels of the sub-pixels in the ON state included in the each of said pixels, supplying a data signal to the static random access memory through the switching transistor;

disposing each of the pixels at separate intersections of scanning lines and signal lines, each of the pixels including at least two of the sub-pixels; and connecting the static random access memory of the at least two sub-pixels of each of the pixels to the same scanning line.

13. An electro-optical device, comprising:

a plurality of signal lines;

a plurality of scanning lines;

a plurality of pixels disposed in a matrix at intersections of the plurality of signal lines and the plurality of scanning lines, each of said pixels including sub-pixels that are each provided with a static random access memory, a switching transistor and an electro-optical element, a size of each of at least two of said sub-pixels being differentiated from each other, a data signal being supplied to the static random access memory through the switching transistor, each of the pixels being disposed at separate intersections of the scanning lines and the signal lines, each of the pixels including at least two of the sub-pixels, and the static random access memory of the at least two sub-pixels being connected to the same scanning line.

14. The electro-optical device according to claim 13, a luminance of each of said electro-optical elements having two values including a lower luminance level and a higher luminance level.

15. The electro-optical device according to claim 14, a grayscale level being set as a function of a sum of luminance levels of said electro-optical elements contained in each of said pixels.

16. The electro-optical device according to claim 14, a grayscale level being set as a function of a ratio of a total area occupied by all of the electro-optical elements contained in one of said pixels to a total area occupied by the electro-optical elements which are set at the higher luminance level.

17. The electro-optical device according to claim 13, said electro-optical elements being liquid crystal elements.

18. The electro-optical device according to claim 17, said liquid crystal elements being reflection-type liquid crystal elements.

19. The electro-optical device according to claim 13, said electro-optical elements being organic electro-luminescence elements.

20. An electronic apparatus comprising the electro-optical device set forth in claim 13.

21. A driving method for an electro-optical device that includes pixels disposed in a matrix at intersections of a plurality of signal lines and a plurality of scanning lines, the pixels including sub-pixels that are each provided with a static random access memory, a switching transistor and an electro-optical element that is disposed within said pixel, a size of each of at least two of said sub-pixels being differentiated from each other, said driving method comprising:

supplying a data signal to control a luminance level of said electro-optical elements to either a higher luminance level or a lower luminance level via said plurality of signal lines to the static random access memory through the switching transistor;

retaining the data signal in a static random access memory disposed within each of said sub-pixels;

disposing each of the pixels at separate intersections of the scanning lines and the signal lines, each of the pixels including at least two of the sub-pixels; and connecting the static random access memory of the at least two sub-pixels of each of the pixels to the same scanning line.

22. A driving method for an electro-optical device that includes pixels disposed in a matrix, each of said pixels including a plurality of sub-pixels provided with a static random access memory and a switching transistor, a size of each of at least two of said sub-pixels being differentiated from each other, the driving method comprising:

controlling said sub-pixels to be in one of an ON state and an OFF state;

obtaining a grayscale by using a ratio of the maximum luminance level of each of said pixels to the sum of luminance levels of the sub-pixels in the ON state included in the each of said pixels;

supplying a data signal to the static random access memory through the switching transistor;

disposing each of the pixels at separate intersections of scanning lines and signal lines, each of the pixels including at least two of the sub-pixels; and connecting the static random access memory of the at least two sub-pixels of each of the pixels to the same scanning line.

* * * * *